US007730551B2

(12) United States Patent
Price

(10) Patent No.: US 7,730,551 B2
(45) Date of Patent: Jun. 8, 2010

(54) UNDERARM GARMENT PROTECTOR

(76) Inventor: Jason Andrew Price, 132 W. 123 St., Unit 2, New York, NY (US) 10027

( * ) Notice: Subject to any disclaimer, the term of this patent is extended or adjusted under 35 U.S.C. 154(b) by 0 days.

(21) Appl. No.: 12/333,523

(22) Filed: Dec. 12, 2008

(65) Prior Publication Data

US 2009/0183292 A1 Jul. 23, 2009

Related U.S. Application Data

(60) Provisional application No. 61/011,698, filed on Jan. 22, 2008.

(51) Int. Cl.
*A41D 27/13* (2006.01)

(52) U.S. Cl. ..... 2/53; 2/54

(58) Field of Classification Search ..... 2/53–58, 2/113, 115, 106, 105, 109, 114, 267, 247, 2/59, 250, 94, 125; 450/89
See application file for complete search history.

(56) References Cited

U.S. PATENT DOCUMENTS

| | | | | | |
|---|---|---|---|---|---|
| 519,487 | A | | 5/1894 | Warner | |
| 813,585 | A | * | 2/1906 | Reid | 2/54 |
| 920,325 | A | * | 5/1909 | Heber | 2/113 |
| 1,059,811 | A | * | 4/1913 | Barrow | 2/54 |
| 2,269,365 | A | * | 1/1942 | Fowler | 2/53 |
| 2,301,881 | A | | 11/1942 | Kalenoff | |
| 2,390,565 | A | * | 12/1945 | Topjian | 2/53 |
| 3,106,718 | A | * | 10/1963 | Raab | 2/125 |
| 3,508,279 | A | * | 4/1970 | Ayoub | 2/113 |
| 3,744,056 | A | * | 7/1973 | Bond | 2/54 |
| 4,275,468 | A | * | 6/1981 | Outlaw | 2/115 |
| 5,079,004 | A | | 1/1992 | Blank et al. | |
| 5,832,536 | A | | 11/1998 | Kramer | |
| 5,864,889 | A | * | 2/1999 | Suffern | 2/247 |
| D417,333 | S | | 12/1999 | Re | |
| 6,187,989 | B1 | | 2/2001 | Corzani et al. | |
| 6,191,189 | B1 | | 2/2001 | Cinelli et al. | |
| 6,316,524 | B1 | | 11/2001 | Corzani et al. | |
| 6,347,407 | B1 | * | 2/2002 | Dowell | 2/113 |
| 6,627,791 | B1 | | 9/2003 | Veglio et al. | |

(Continued)

OTHER PUBLICATIONS

RealCo Inc., Apparel with DriRx Technology, http://www.advantagewear.com/mensclothing.html, printed Dec. 18, 2008.

(Continued)

*Primary Examiner*—Amy B Vanatta
(74) *Attorney, Agent, or Firm*—Pearl Cohen Zedek Latzer, LLP

(57) ABSTRACT

An armpit sweat absorption system comprised of a disposable absorption pad that is placed inside a pocket located under the armpit of a conventional yet modified men and women's undershirt. The pocket, located at the arm pit location serves as an "under-pocket" to contain the disposable absorption pad. The under-pocket is a simple layer of undershirt material that reinforces the under arm and has room to hold the pad. The pad material is a composite of gauze-like cotton material suitable for absorbing moisture. The combined effort of under pocket and absorption pad is meant to absorb unsightly under-arm perspiration and provide garment protection from clothes fading and discoloration due to sweating and deodorant stains that tend to drain through.

12 Claims, 3 Drawing Sheets

U.S. PATENT DOCUMENTS

| | | | |
|---|---|---|---|
| 7,232,858 | B2 | 6/2007 | Bonfanti et al. |
| 7,311,941 | B2 | 12/2007 | Cesiro et al. |
| 2004/0098783 | A1 | 5/2004 | Parson et al. |
| 2004/0258903 | A1 | 12/2004 | Eberle |

OTHER PUBLICATIONS

Kleinerts, The World's Authority on Sweat Protection. Official Website Serving Consumers & Industry Since 1869, http://www.kleinertsshields.com/gclid=CMG50bif_5YCFQKHxwodgnNtAQ, printed Dec. 18, 2008.

* cited by examiner

UNDERARM GARMENT PROTECTOR

CROSS REFERENCE TO RELATED APPLICATIONS

This application claims the benefit under 35 U.S.C. §119 (e) of U.S. Provisional Patent Application No. 61/011,698, filed Jan. 22, 2008, which is hereby incorporated by reference.

BACKGROUND OF THE INVENTION

1. Field of Invention

The present invention relates to underarm protection and garment protection in the course of underarm perspiration. Specifically, the system is used for both reducing the effects on clothes of absorbed perspiration and guarding the outer garment from unsightly stains of perspiration and stains caused by deodorant and perspiration leakage that builds up on the shirt around the area of the armpit.

2. Prior Art

U.S. Design Pat. No. Des. 417,333 to Re shows a pocket for attachment at about the rib cage region (under the arm) of a sleeveless undershirt and is designed for the pocket to serve as a harness for carrying a holster, handcuff or other mechanical instrument.

U.S. Pat. No. 5,832,536 to Kramer shows an undergarment with an integrally stitched pocket at about the rib cage region beneath the arm to be used as a holster and to secure the weapon in a concealed fashion adjacent the body and ready for use.

U.S. Patent Application Publication No. 2004/0083529 to Tate describes a moisture-absorbing fitness or work out garment with protective pockets designed for the containment of valued items. The garment includes waterproofing materials and sown side pockets that serve to hold a towel, keys, or other valued item.

U.S. Patent Application Publication No. 2004/0098783 to Parson, describes an absorption device using excess cloth fastened to lingerie. These sleeves form folds of sleeve material under the armpits that absorb perspiration and prevent staining the outer garment. Attached to lingerie, the sleeves have bights formed in the sleeve material. These bights prevent the sleeve material from gathering, or bundling, as the lingerie shoulder straps are adjusted to adapt to the wearer's physique, thereby establishing a smooth transition from the sleeves to the lingerie that avoids forming unsightly humps in the outer garment surface. When the sleeves are used with a body shirt, a crotch strap is provided on the body shirt to stabilize the body shirt on the wearer's torso and to prevent the body shirt from "riding up" on the wearer's torso during strenuous physical activity.

U.S. Patent Application Publication No. 2004/0258903 A1 to Eberle, describes a treated absorption and perspiration pad that uses adhesives to fasten to an underarm area of an upper torso garment such as a shirt, blouse, or tee shirt.

U.S. Pat. No. 6,187,989 relates to breathable absorbent articles particularly sanitary napkins, panty liners, adult incontinence products or sweat pads particularly such breathable absorbent articles which are worn by direct attachment to the skin of the wearer in the area where absorption of bodily liquids is desired.

What does not exist in the market place is a one-piece garment that serves the purpose of providing an extra layer of absorption support in a self-contained shirt. The wearer should be able to easily remove and replace such an extra layer of absorption support at will. The extra layer of absorption support should also be held in place without causing discomfort or disruption to every day wear. None of the above prior art patents and patent applications, taken individually or in combination, provides the desired extra layer of absorption support.

SUMMARY OF THE INVENTION

It is one object of the present invention to provide a wearable garment that contains an extra layer of absorption support.

It is another object of the present invention to provide such a wearable garment to which a separate absorption pad may be applied but to which it is not directly attached using an adhesive. When exposed to heat and moisture, adhesives can leech into the garment, causing damage to said garment.

It is a further another object of the present invention to provide such an absorption pad that is held in place without causing discomfort or disruption to every day wear.

It is still another object of the present invention to provide such an absorption pad that is removable and replaceable. Attaching the absorption pad permanently to the garment may require the user to use special care procedures when washing the garment, and failure to follow those procedures could cause damage to the garment or to the absorption pad.

It is yet another object of the present invention to provide such an absorption pad that is washable, so as to enable it to be used and re-used by the user.

It is yet a further object of the present invention to provide such an absorption pad that is disposable, so as to enable the user to discard it after use.

In accordance with these and other objects, the present invention provides a modified conventional garment, such as a shirt or undershirt. The conventional garment is provided with a pocket, made of the same or similar material as the conventional garment, that is sewn into or onto the garment in the underarm region. A washable absorbent pad, such as known in the art, may be inserted into and removed from this pocket to provide an extra layer of perspiration absorption protection for the user. Thus, the present invention comprises two parts: a modified conventional undershirt that contains a pocket and a removable and disposable cotton absorption pad for the purpose of placement in the under pocket.

In one embodiment, a patch-type pocket is made of one piece of material and is stitched to the garment on three of four sides, leaving one side open for the insertion and removal of an absorption pad. In a first embodiment, this open side is the lower-most side of the garment underarm region. In another embodiment, this open side is the upper-most side of the garment underarm region. In a third embodiment, the front side of the pocket is open. In a fourth embodiment, the back side of the pocket is open.

In another embodiment, the patch-type pocket is made of two separate pieces of material, each piece being sewn closed on three of four sides. In this embodiment, it is preferable that the two open sides face each other.

In a further embodiment, the patch-type pocket is made of one piece of material, sewn closed on all four sides but having a slit or cut somewhere within its body for access to the pocket within.

In one embodiment, the patch-type pocket is sewn to the outside of the garment. In another embodiment, the patch-type pocket is sewn to the inside of the garment.

The pocket may also be a pouch-type pocket, wherein a pouch extends inward toward the interior of the garment and is sewn to the outer edges of a hole or slit in the garment that is formed through the underarm region.

The absorption pad can be cotton padding, cellulosic fiber material, cotton tissues, terry cloth, modified feminine hygiene pad, gauze pad, or any other gauze-like or readily available absorption material for the purpose of absorbing perspiration and garment protection. The pad may be disposable or may also be washable and reusable.

In another embodiment, the absorbent pad has one side that is substantially impermeable, e.g., one side may be coated with a fluid resistant coating. In a preferred embodiment, when the absorbent pad is inserted into the pocket, the coated side of the absorbent pad is faced away from the wearer, such that the pad absorbs the wearer's sweat but does not allow that sweat to pass therethrough to the garment.

Thus, a convenient, low cost, and highly practical solution with a reinforced under shirt located in the under armpit with a pocket to hold any absorption device is desired.

BRIEF DESCRIPTION OF THE DRAWINGS

Embodiments of the invention will be understood and appreciated more fully from the following detailed description in conjunction with the figures, which are not to scale, in which like reference numerals indicate corresponding, analogous or similar elements, and in which.

DETAILED DESCRIPTION OF THE PRESENT INVENTION

The following preferred embodiments as exemplified by the drawings are illustrative of the invention and are not intended to limit the invention as encompassed by the claims of this application.

Figure 1:
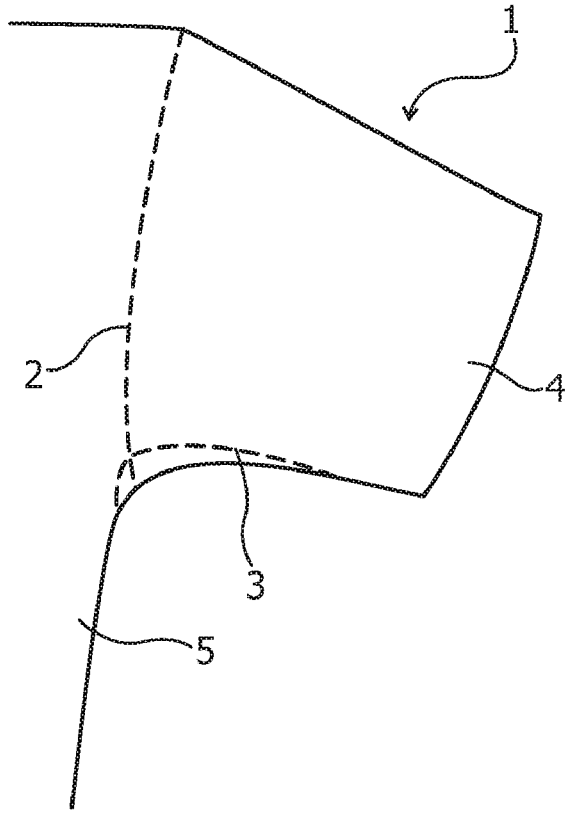
FIG. 1 (PRIOR ART)
FIG. 1 shows a side view of a conventional, prior art undershirt.

The invention as described herein may be any garment that is worn on the upper body of a wearer. FIG. 1 shows one example of a prior art garment 1 that may be modified by the invention hereof. In this embodiment, garment 1 may be a conventional shirt, such as a short-sleeved T-shirt or undershirt, that is worn over the upper body of an individual and may be made from any fabric from which such garments are normally made, such as cotton, linen, wool or other fabrics. The conventional undershirt 1 has a body portion 5, on each of the left and right sides of which one sleeve 4 is attached thereto along a seam 2. The underarm area 3 of the sleeve 4 is most affected by the wearer's perspiration, and unsightly wetness or stains often result. It is to this area that the pocket as described therein is to be attached.

Figure 2:
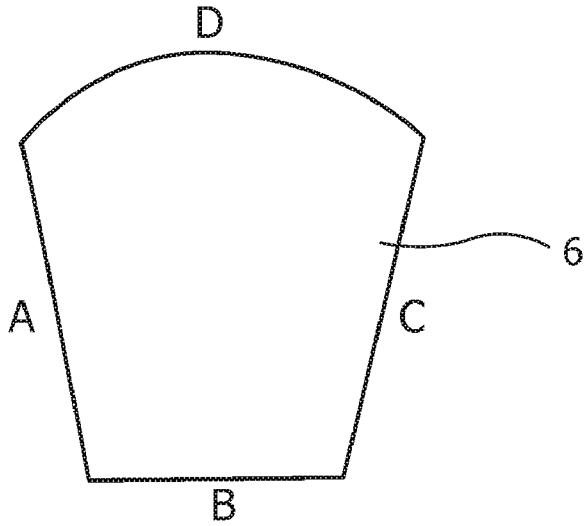
FIG. 2 shows a detached pocket patch that may be sewn onto the underside of the arm pit area of the undershirt.

In one embodiment, a patch-type pocket is formed by sewing an extra layer of material is sewn on the garment at the location of the underarm region 3. FIG. 2 shows one embodiment of the patch-type pocket 6 that may be sewn onto or into the garment. Pocket 6 may be a piece of fabric, preferably fabric that is similar to or matches the fabric of garment 1. The pocket 6 may be in the form of a patch and have various dimensions, such as rectangular, square, trapezoidal, etc. In one embodiment, the fabric pocket 6 may have four sides A-D.

In a preferred embodiment, pocket 6 is sized such that it is generally positioned about the underarm of a wearer. In one embodiment, the pocket 6 is sized to cover the general area under the arm of a user where wetness collects. In such an embodiment, the size of the pocket is about 8"×8" but can be as small as about 4"×6" and as large as about 10"×10".

It should be noted that other types of pockets may be used, such as a pouch-type pocket that is sewn to the inside of the garment about a slit in the garment for access thereto.

Figure 3:
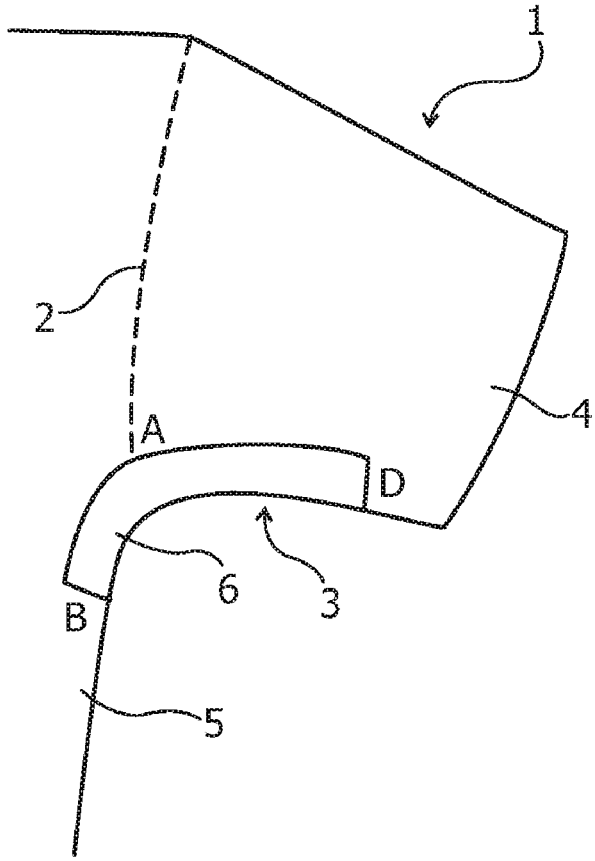
FIG. 3 shows a side view of a conventional undershirt onto the underside of the arm pit area of which the pocket patch has been sewn.

FIG. 3 shows the patch-type pocket 6 of FIG. 2 applied to the underarm region 3 of the garment 1. The patch-type pocket 6 is preferably formed of a piece of the same material from which garment 1 is made. Pocket 6 may be applied to garment 1 in any known manner as pockets are typically applied to garments, such as by sewing or adhesive (in the manner that fabrics or materials are often adhered together, such as by a heat or pressure activated adhesive).

Perspiration tends to tarnish shirts and other garments over time. Deodorant applications can seep into the garment further damaging the overall quality. The pocket reinforces the general area, and the insertion of an absorption pad or other device can further reduce the damage to garments caused by perspiration. Thus, the pocket is placed for optimal perspiration absorption and garment protection. The location of pocket 6 is, in a preferred embodiment, on the underside of the undershirt at the armpit region, which will serve to absorb perspiration. In one embodiment, pocket 6 extends from near the far edge of the sleeve to approximately 3 inches below the center of the underarm region 3.

According to one embodiment of the invention, there should always be at least one opening for easy access to add and remove the absorption pad. It is desirable for the pocket 6 to be open only on one side. In one embodiment, three of the four sides A-D of the pocket 6 are sewn to the garment 1, leaving the fourth side is open to serve as the access to the inside of the pocket 6 to insert and remove an absorption pad or other absorption material used to absorb perspiration.

Referring to FIG. 3, in a first embodiment, side B, the end facing the lower-most side of the garment underarm region, i.e., the end of pocket 6 closest to body 5, is the open access end. In a second embodiment, side D, the end of pocket 6 facing the upper-most side of the garment underarm region, i.e., the end of pocket 6 closest to the edge of sleeve 4, is the open access end. In a third embodiment, side A, the side of pocket 6 closest to the front of garment 1, is the open access end. In a fourth embodiment, side C (not shown in FIG. 3), the side of pocket 6 closest to the back of garment 1, is the open access end.

In one embodiment wherein the pocket 6 to be open only on one side, the fourth side of pocket 6 that remains open is open completely across that side's opening. In another embodiment, the fourth side of pocket 6 that remains open is open less than completely across that side's opening. Having less than the entire side of pocket 6 open will allow pocket 6 to more securely retain the absorbent pad that is retained therein. For example, if side D, the end of pocket 6 closest to the edge of sleeve 4, is the open access end, only approximately ¾ of side D will be open across side D, while approximately ¼ will remain sewn or applied shut.

An absorption pad 8 may be placed inside pocket 6 so that it is retained thereby. A preferred absorption pad 8 is formed from or contains absorbent materials, preferably in one or more layers, for the purpose of absorbing moisture, such as perspiration from the wearer's underarm. Absorption pad 8 is preferably a cellulosic or fibrous product, such as a gauze-like cotton/tissue material or any other material that is suited for quick absorption, such as cotton, terry cloth, modified feminine hygiene pad, gauze pad, etc., or any other low cost disposable and/or recyclable material. Absorption pad 8 may be layered or multilayered with such materials or fabrics.

Absorption pad 8 is preferably lightweight, and sized to be fit or nestled conveniently and comfortably under the wearer's armpit. In one embodiment, the pad 8 is approximately one inch (or less) thick and approximately 5"×5" pad. Of course, absorption pad 8 may be larger or smaller, depending upon the wearer's size and comfort.

Absorption pad 8 is placed inside pocket 6 so that it absorbs the perspiration of the wearer. In one embodiment, absorption pad 8 is washable so that it may be reused. In another embodiment, absorption pad 8 be comprised of a disposable material so that it may be discarded after use. In some preferred embodiments, absorption pad 8 may contain or may be treated with an antiperspirant, such as aluminum zirconium chlorohydrate, and/or a deodorizing component and/or a scenting element, so as to maintain the wearer's freshness in the underarm region. It should be noted that the antiperspirant, deodorizing component and scenting element can be different for an absorption pad 8 to be incorporated into a male's clothing and an absorption pad 8 to be incorporated into a female's clothing.

In one embodiment, the absorbent pad has one side that is substantially impermeable, e.g., one side may be coated with a fluid resistant coating. In a preferred embodiment, when the absorbent pad is inserted into the pocket, the coated side of the absorbent pad is faced away from the wearer, such that the pad absorbs the wearer's sweat but does not allow that sweat to pass therethrough to the garment. Of course, in another embodiment, neither side of the absorbent pad is coated with such a fluid resistant coating.

In another embodiment, absorption pad 8 contains a crease or a scored area to allow it to flex within the underarm region of the wearer and for better placement in pocket 6 to contour with the wearer's armpit.

It is preferred that there be sufficient space in the pocket 6 around absorption pad 8 to allow for pad breath-ability and removal of absorption pad 8. However, pocket 6 should securely hold the absorption pad 8 in place, and should not employ any complex fasteners or adhesives that would make insertion and removal of the absorption pad 8 anything but easy.

Figure 4A:
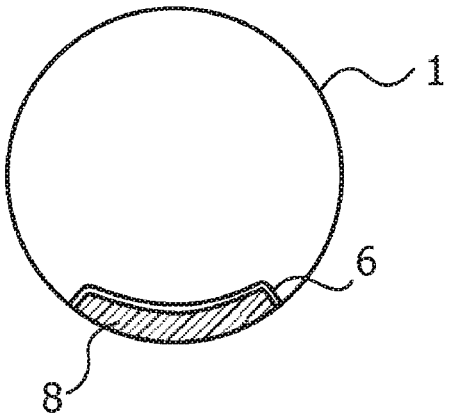
FIG. 4A shows an end view of the undershirt sleeve with the underarm pocket attached to the inside surface thereof.

In one embodiment, the patch-type pocket 6 is sewn to the inside of the garment, as shown in FIG. 4A. The orientation of this pocket, i.e., which end is open, is discussed above. In this embodiment, the absorption pad 8 must be inserted into the pocket 6 from the inside of the garment 1.

Figure 4B:
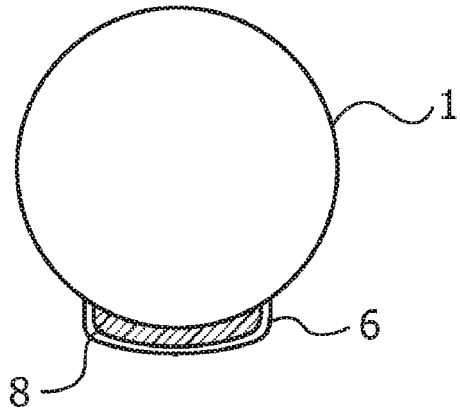
FIG. 4B shows an end view of the undershirt sleeve with the underarm pocket attached to the outside surface thereof.

In another embodiment, the pocket is sewn to the outside of the garment, as shown in FIG. 4B. The orientation of this pocket, i.e., which end is open, is discussed above. In this embodiment, the absorption pad 8 must be inserted into the pocket 6 from the outside of the garment 1.

Figure 5:
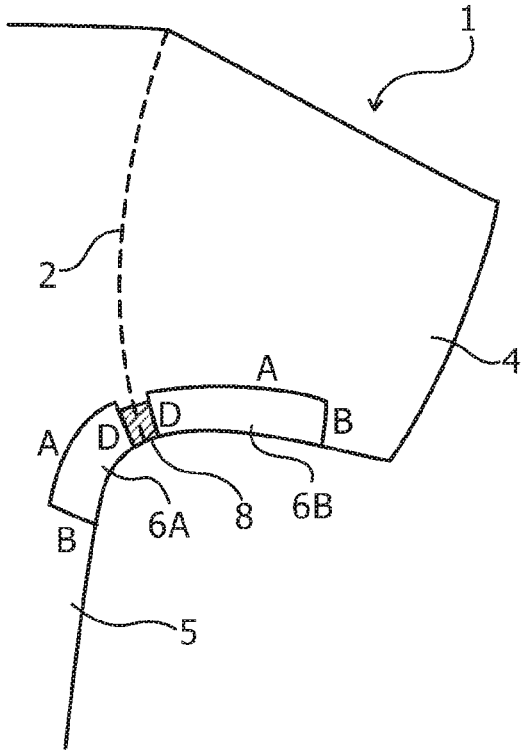
FIG. 5 shows a side view of a conventional undershirt onto the underside of the arm pit area of which a second embodiment of the underarm pocket has been sewn.

In another embodiment, as shown in FIG. 5, the pocket 6 can be made of two separate pieces of material, rather than one. In this embodiment, pocket 6 is formed from two subpockets 6A,6B, each of which is applied to the garment 1 in the same manner as pocket 6 discussed above. In addition, each subpocket 6A,6B is sewn closed on three of four sides A,B,C, with the open side D of subpocket 6A facing the open side D of subpocket 6B. In order to insert absorbent pad 8, one end of absorbent pad 8 must first be inserted into one of subpockets 6A and 6B through open side D thereof, and then the other end of absorbent pad 8 is inserted into the other of subpockets 6A and 6B through open side D thereof. When the garment 1 is used with subpockets 6A,6B as shown in FIG. 5, there is less chance that absorbent pad 8 will fall out of the pockets, since it is securely maintained between subpockets 6A and 6B.

Figure 6:
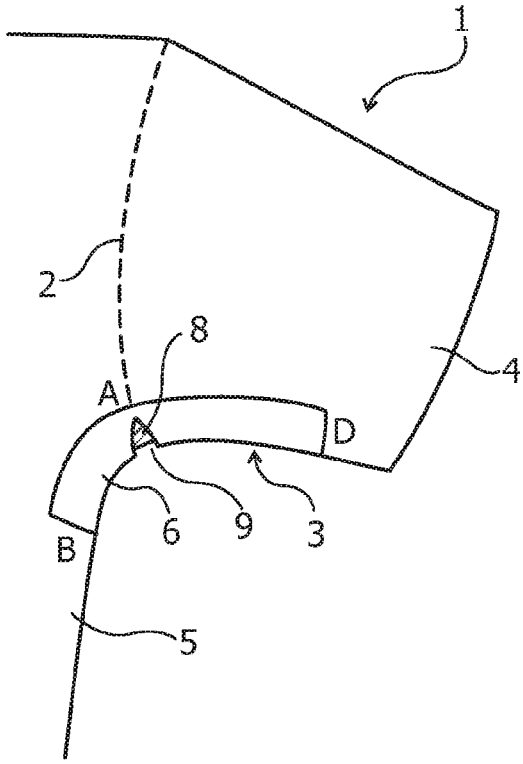
FIG. 6 shows a side view of a conventional undershirt onto the underside of the arm pit area of which a third embodiment of the underarm pocket has been sewn.

In a further embodiment, as shown in FIG. 6, all four the sides A-D of the pocket 6 are sewn to the garment 1. In this embodiment, access to the inside of the pocket 6 to insert and remove absorption pad 8 or other absorption material used to absorb perspiration is gained through a slit or cut 9 that is made into the fabric of pocket 6. Slit 9 may be generally in the center region of pocket 6 or may be closer to one side or end of pocket 6. In order to insert absorbent pad 8, one end of absorbent pad 8 must first be inserted into a first side or end of pocket 6 (for example, in the direction toward end B) through slit 9, and then the other end of absorbent pad 8 is inserted into the other side or end of pocket 6 (for example, in the direction toward end D) through slit 9. When the garment 1 is used with pocket 6 as shown in FIG. 6, there is less chance that absorbent pad 8 will fall out of the pocket 6, since it is securely maintained between both side or ends B and D of pocket 6.

Thus, an underarm garment protector has been provided. One skilled in the art will appreciate that the present invention can be practiced by other than the described embodiments, which are presented for purposes of illustration and not limitation, and that the invention is limited only by the claims that follow. Further, since numerous modifications and changes will readily occur to those skilled in the art, it is not desired to limit the invention to the exact construction and operation shown and described, and accordingly, all suitable modifications and equivalents may be resorted to, without departing from the scope or spirit of the invention as defined in the appended claims.

What is claimed is:

1. A perspiration protective garment, comprising:

a garment to be worn on the upper body of a wearer, said garment having at least one sleeve and an underarm region under said sleeve;

a pocket attached to said underarm region, wherein said pocket is a unitary piece of material attached to said underarm region completely around the circumference thereof and having an opening therethrough; and a piece of absorbent material for removable insertion into said pocket through said opening.

2. The perspiration protective garment of claim 1, wherein said pocket is attached to said underarm region by at least one of sewing, bonding or adhesion.

3. The perspiration protective garment of claim 1, wherein said pocket is attached to the outer surface of said garment.

4. The perspiration protective garment of claim 1, wherein said pocket is attached to the inner surface of said garment.

5. The perspiration protective garment of claim 1, wherein said pocket is adapted to retain therein said piece of absorbent material.

6. The perspiration protective garment of claim 5, wherein said pocket is at least partially open for insertion and removal of said absorbent material.

7. The perspiration protective garment of claim 1, wherein said piece of absorbent material is coated with a moisture impervious coating on one side thereof.

8. A perspiration protective pocket in a garment, said garment for wearing on the upper body of a wearer and having at least one sleeve and an underarm region under said sleeve, said pocket comprising a unitary piece of garment material attached to said underarm region completely around the circumference thereof and having an opening therethrough for insertion of an absorbent material into said pocket.

9. The perspiration protective pocket of claim 8, wherein said material is attached to said underarm region by at least one of sewing, bonding or adhesion.

10. The perspiration protective pocket of claim 8, wherein said garment material is attached to the outer surface of said garment.

11. The perspiration protective pocket of claim 8, wherein said garment material is attached to the inner surface of said garment.

12. The perspiration protective pocket of claim 8, wherein said pocket is adapted to retain therein an absorbent material.

* * * * *